US008325960B2

(12) United States Patent
Akino

(10) Patent No.: US 8,325,960 B2
(45) Date of Patent: Dec. 4, 2012

(54) NARROW DIRECTIONAL MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 44 days.

(21) Appl. No.: 12/929,908

(22) Filed: Feb. 24, 2011

(65) Prior Publication Data

US 2011/0222718 A1 Sep. 15, 2011

(30) Foreign Application Priority Data

Mar. 11, 2010 (JP) ..... 2010-054053

(51) Int. Cl.
*H04R 25/00* (2006.01)

(52) U.S. Cl. ..... 381/356; 381/357; 381/355

(58) Field of Classification Search ..... 381/355, 381/356, 357, 358, 359, 360, 361, 368, 369, 381/174, 189

See application file for complete search history.

(56) References Cited

U.S. PATENT DOCUMENTS 4,757,546 A * 7/1988 Akino ..... 381/357
2006/0078145 A1* 4/2006 Akino ..... 381/356
2010/0189298 A1* 7/2010 Akino et al. ..... 381/356

* cited by examiner

*Primary Examiner* — Huyen D Le
(74) *Attorney, Agent, or Firm* — Manabu Kanesaka

(57) ABSTRACT

There is provided a narrow directional microphone in which the acoustic resistance of an acoustic tube scarcely varies, and a larger-diameter condenser microphone unit can be used without increasing the external dimensions. In the narrow directional microphone in which a unidirectional condenser microphone unit 30 is housed in an acoustic tube 10 the front end of which is open as a front sound wave introduction port 11 and which has side sound wave introduction ports 13 in the tube peripheral surface thereof and is provided with rear sound wave introduction ports 14 on the rear end side, and a microphone casing 20 that is larger in dimension and longer than the acoustic tube 10 is arranged so as to cover the acoustic tube 10, as the acoustic tube 10, a cylindrical body formed by rounding a flexible sheet (preferably, a metal sheet) is used, and at least the side sound wave introduction ports 13 provided on the acoustic tube 10 are formed by a large number of pores formed in the sheet.

9 Claims, 5 Drawing Sheets

EQUIVALENT SPL

NARROW DIRECTIONAL MICROPHONE

CROSS-REFERENCE TO RELATED APPLICATION

The present application is based on, and claims priority from, Japanese Application Serial Number JP2010-054053, filed Mar. 11, 2010, the disclosure of which is hereby incorporated by reference herein in its entirety.

TECHNICAL FIELD

The present invention relates to a narrow directional microphone that houses a unidirectional condenser microphone unit in an acoustic tube and, more particularly, to a configuration of the acoustic tube.

BACKGROUND ART

A narrow directional microphone is configured so as to house a unidirectional condenser microphone unit in an acoustic tube (interference pipe), and is also called a line microphone, a gun microphone, or the like because the acoustic tube is a slender cylindrical tube having a predetermined axial length.

One example of the configuration of a conventional narrow directional microphone is explained with reference to FIG. 5, which is a longitudinal sectional view thereof, and FIG. 6, which is a sectional view taken along the line B-B of FIG. 5. The narrow directional microphone includes a tube member consisting of an acoustic tube 10 and a microphone casing 20, each consisting of a cylindrical tube, and as a microphone unit, a unidirectional condenser microphone unit 30 is used.

A front end 10*a* directed to the sound source side of the acoustic tube 10 is open as a front sound wave introduction port 11. A rear end 10*b* is closed by a gasket 12. In the tube peripheral surface of the acoustic tube 10, side sound wave introduction ports 13 are formed. On the rear end side of the acoustic tube 10, rear sound wave introduction ports 14 are formed.

The side sound wave introduction ports 13 are arranged at two opposed places on the tube peripheral surface with a 180° interval being provided therebetween, and in this example, each of the side sound wave introduction ports 13 is formed as one slit (elongated hole). This slit may be divided into a plurality of slits. Also, in place of the slit, a plurality of round holes are sometimes arranged along the axial direction of the acoustic tube 10.

In any case, as described in Patent Document 1 (Japanese Patent Application Publication No. 2000-50385), to the side sound wave introduction port 13, an acoustic resistance material 15 consisting of nonwoven fabric, nylon mesh; or the like is affixed. To the rear sound wave introduction port 14 as well, an acoustic resistance material of the same kind is sometimes affixed.

The microphone casing 20, which is larger in diameter and longer than the acoustic tube 10, is put coaxially over the acoustic tube 10. In the tube peripheral surface of the microphone casing 20, openings 21 are formed in portions facing the side sound wave introduction ports 13 and the rear sound wave introduction ports 14.

Between the microphone casing 20 and the acoustic tube 10, a wire mesh 22 for shielding extraneous electromagnetic waves is provided. In the tube of the microphone casing 20 extending to the rear (the right-hand side in FIG. 5) beyond the acoustic tube 10, a circuit board having a sound signal output circuit and the like is housed.

The condenser microphone unit 30 is disposed between the side sound wave introduction ports 13 and the rear sound wave introduction ports 14 in the state in which in the acoustic tube 10, a front acoustic terminal 30*a* is directed to the front sound wave introduction port 11 side, and a rear acoustic terminal 30*b* is directed to the rear sound wave introduction port 14 side. Signal output wires 31 of the condenser microphone unit 30 are pulled out via an insertion hole formed in the gasket 12, and are connected to the predetermined terminals of the circuit board.

In the narrow directional microphone, the acoustic resistance material 15 provided especially on the side sound wave introduction port 13 exerts an important influence on the sensitivity, frequency response, and directivity. Conventionally, an adhesive is applied manually to the acoustic resistance material 15 to affix it. Therefore, the acoustic resistance is varied by the oozing of adhesive, the way of affixing, and the like, which poses a problem in terms of quality control.

Also, concerning the condenser microphone unit 30 used, the larger the diameter thereof, the larger the effective vibration area. Therefore, the condenser microphone unit 30 having a large diameter is advantageous in terms of high sensitivity and low noise. However, the diameter of the unit 30 is restricted by the inside diameter of the acoustic tube 10.

In the above-described conventional example, since the wire mesh 22 for shielding extraneous electromagnetic waves must be provided between the microphone casing 20 and the acoustic tube 10, the diameter of the acoustic tube 10 decreases accordingly. Therefore, there also arises a problem that it is difficult to mount a large-diameter condenser microphone unit providing high sensitivity and low noise.

To solve this problem, the diameters of both the microphone casing 20 and the acoustic tube 10 have only to be increased. In this case, however, the whole of microphone becomes large in size and heavy in weight. Therefore, the compactness and lightweight required for the narrow directional microphone are sacrificed, so that this solution cannot be said to be preferable.

Accordingly, an object of the present invention is to provide a narrow directional microphone in which the acoustic resistance of an acoustic tube scarcely varies, and a larger-diameter condenser microphone unit can be used without increasing the external dimensions.

SUMMARY OF THE INVENTION

To achieve the above object, the present invention provides a narrow directional microphone including an acoustic tube the front end of which is open as a front sound wave introduction port and which has a side sound wave introduction port in the tube peripheral surface thereof and is provided with a rear sound wave introduction port on the rear end side; a unidirectional condenser microphone unit disposed between the side sound wave introduction port and the rear sound wave introduction port in the acoustic tube; and a cylindrical microphone casing that is larger in diameter and longer than the acoustic tube, has an opening in a portion corresponding to the side sound wave introduction port and the rear sound wave introduction port, and is arranged so as to cover the acoustic tube, wherein the acoustic tube consists of a cylindrical body formed by rounding a flexible sheet, and at least the side sound wave introduction port is formed by a large number of pores formed in the sheet.

According to the present invention, as the acoustic tube, a cylindrical body formed by rounding a flexible sheet is used, and the side sound wave introduction port and rear sound wave introduction port provided on the acoustic tube are formed by the large number of pores formed in the sheet. Thereby, the acoustic resistance required for the acoustic tube is made stable, so that narrow directional microphones of equal quality are provided.

According to a preferable mode of the present invention, the sheet is a metal sheet, and the large number of pores are formed in the metal sheet by etching so that both the pore diameters and the pitches are almost equal.

The sheet may be a synthetic resin sheet having metalized film. However, according to the metal sheet, the large number of pores can be formed in the metal sheet by etching so that both the pore diameters and the pitches are almost equal. Also, according to the metal sheet or the synthetic resin sheet having metalized film, the sheet can also be used as a wire mesh for shielding extraneous electromagnetic waves.

Also, as the sheet, a synthetic resin sheet having metalized film may be used. Anyway, it is preferable that the sheet be elastically deformable, and be stuck fast to the inner surface of the microphone casing by the restoring force of the sheet.

By making the configuration such that the sheet is elastically deformable, and is stuck fast to the inner surface of the microphone casing by the restoring force of the sheet, the inside diameter of the acoustic tube is enlarged to a diameter close to the inside diameter of the microphone casing, so that a larger-diameter condenser microphone unit can be used.

DETAILED DESCRIPTION

A narrow directional microphone in accordance with an embodiment of the present invention will now be described with reference to FIGS. 1 to 3. The present invention is not limited to the embodiment described below.

Figure 1:
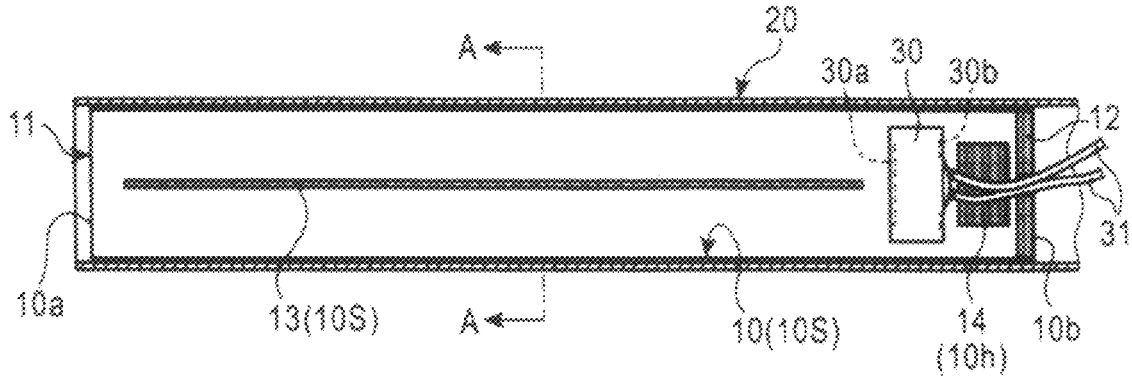
FIG. 1 is a longitudinal sectional view of a narrow directional microphone in accordance with an embodiment of the present invention.
Figure 2:
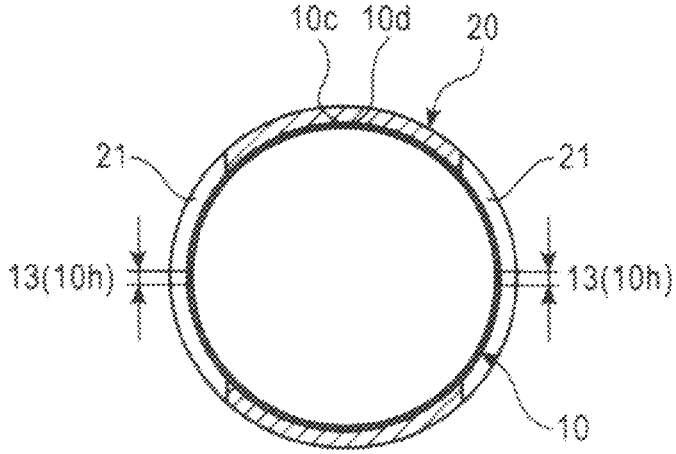
FIG. 2 is a sectional view taken along the line A-A of FIG. 1.
Figure 5:
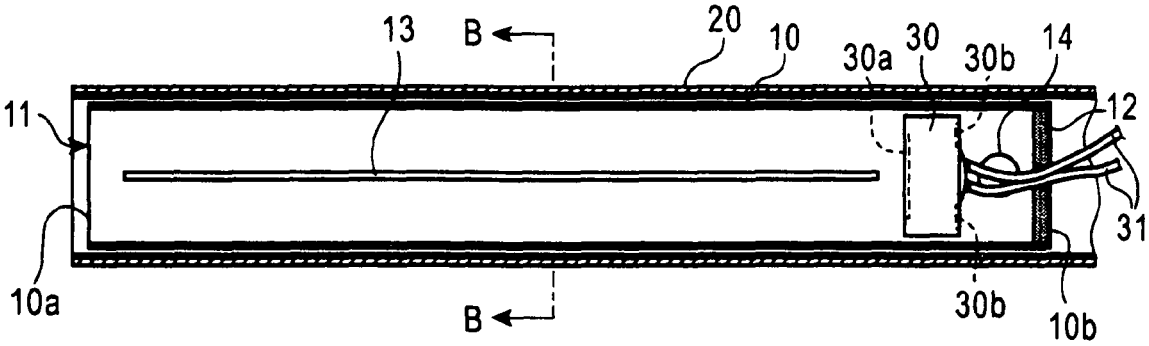
FIG. 5 RELATED ART
FIG. 5 is a longitudinal sectional view of a narrow directional microphone in accordance with a conventional example.
Figure 6:
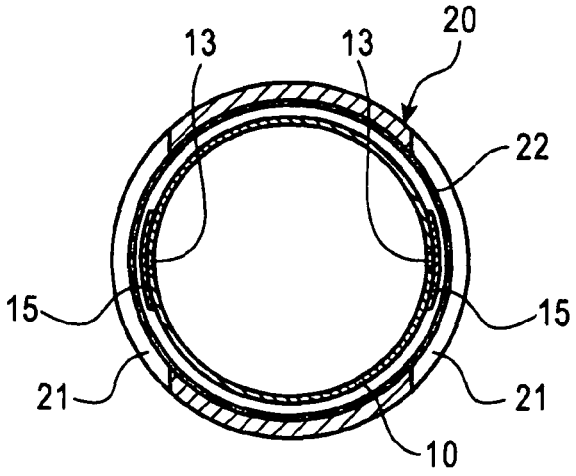
FIG. 6 RELATED ART
FIG. 6 is a sectional view taken along the line B-B of FIG. 5.

Referring to FIGS. 1 and 2, the configuration of the narrow directional microphone in accordance with this embodiment is almost the same as that of the conventional example having been explained with reference to FIGS. 5 and 6. The narrow directional microphone in accordance with this embodiment includes, as the basic configuration, a front sound wave introduction port 11 the front end 10*a* of which is open, an acoustic tube 10 having side sound wave introduction ports 13 and rear wave introduction ports 14, a microphone casing 20, and a unidirectional condenser microphone unit 30. The microphone casing 20 and the condenser microphone unit 30 may have the same configuration as those in the conventional example.

That is, the microphone casing 20 is larger in diameter and longer than the acoustic tube 10, and in the tube peripheral surface thereof, openings 21 are formed in portions facing the side sound wave introduction ports 13 and the rear sound wave introduction ports 14 of the acoustic tube 10. Also, in the tube of the microphone casing 20 extending to the rear (the right-hand side in FIG. 1) beyond the acoustic tube 10, a circuit board having a sound signal output circuit and the like is housed.

The condenser microphone unit 30 is disposed between the side sound wave introduction ports 13 and the rear sound wave introduction ports 14 in the state in which in the acoustic tube 10, a front acoustic terminal 30*a* is directed to the front sound wave introduction port 11 side, and a rear acoustic terminal 30*b* is directed to the rear sound wave introduction port 14 side. Signal output wires 31 of the condenser microphone unit 30 may be pulled out via an insertion hole formed in a gasket 12, and may be connected to the predetermined terminals of the circuit board.

Figure 3:
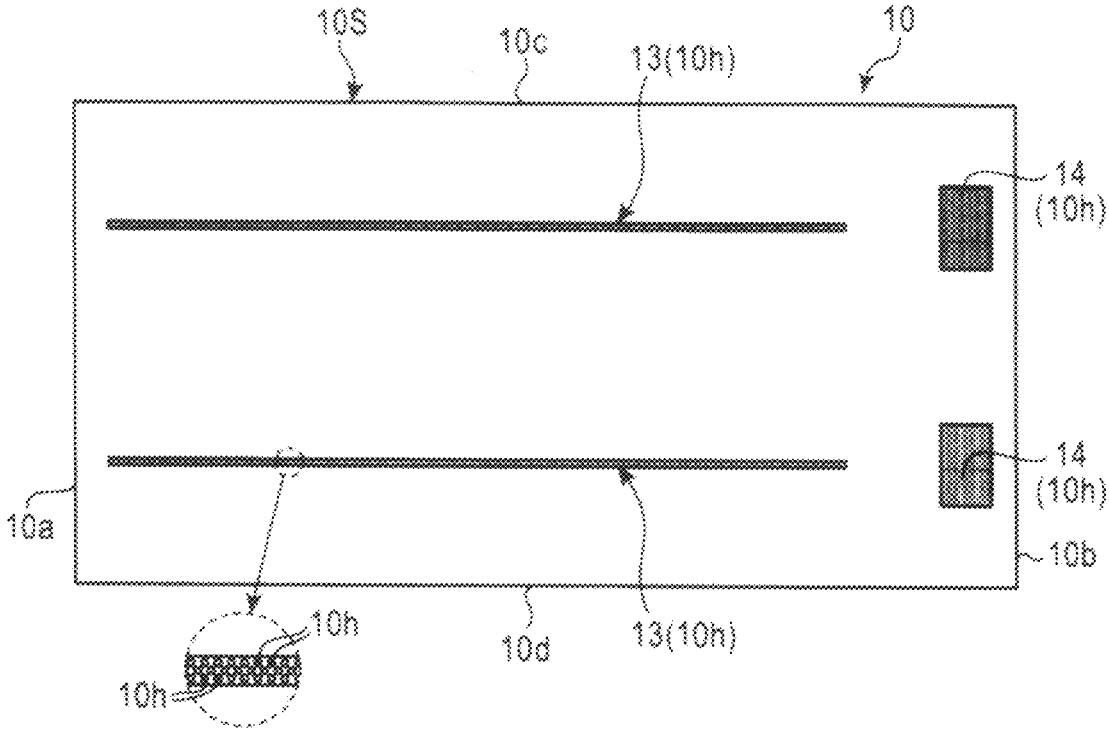
FIG. 3 is a development view of a developed sheet used for an acoustic tube in an embodiment of the present invention.

In this embodiment, the acoustic tube 10 consists of a cylindrical tube formed by rounding a metal sheet 10S shown in the development view of FIG. 3 so that long-side edges 10*c* and 10*d* thereof are butted each other.

As the metal sheet 10S, for example, a 0.05-mm thick metal sheet made of SUS304 is preferably used. However, any metal sheet that can be rounded and has an elastic restoring force can be used. Also, the width between the long-side edges 10*c* and 10*d* is preferably almost equal to the inner peripheral length of the microphone casing 20. However, the width may be slightly narrower or wider than the inner peripheral length of the microphone casing 20.

As shown in the partially enlarged view of FIG. 3, in this embodiment, the side sound wave introduction ports 13 and the rear sound wave introduction ports 14 consist of a large number of pores 10*h* formed in portions of the side sound wave introduction ports 13 and the rear sound wave introduction ports 14 of the metal sheet 10S.

The pores 10*h* can be formed by mechanical hole forming such as punching; however, they are preferably formed by chemical etching. By etching, uniform fine pores can be formed exactly and easily.

In this embodiment, 0.1-mm diameter fine pores are formed at a pitch of 0.25 mm in a zigzag form by etching in the portions of the side sound wave introduction ports 13 and the rear sound wave introduction ports 14 of the metal sheet 10S.

The assembling work is very simple. Specifically, the metal sheet 10S is rounded into a cylindrical form having a diameter smaller than the inside diameter of the microphone casing 20, the rounded metal sheet 10S is inserted into the microphone casing 20 so that the side sound wave introduction ports 13 and the rear sound wave introduction ports 14 are located approximately in the center of the openings 21 of the microphone casing 20, and thereafter the state of being rounded to a small diameter (the diameter decreasing state) is released.

Thereby, the metal sheet 10S is made the acoustic tube 10 by being stuck fast to the inner surface of the microphone casing 20 by the elastic restoring force of the metal sheet 10S. According to this assembling method, an adhesive or the like for fixing the acoustic tube 10 to the inside of the microphone casing 20 is not needed especially.

Also, since the large number of pores 10*h* act as acoustic resistance, an acoustic resistance material consisting of non-woven fabric, nylon mesh, or the like need not be affixed separately, and stable acoustic resistance consisting of the large number of pores 10*h* is obtained, so that narrow directional microphones of equal quality can be provided.

The present invention does not completely exclude a mode in which the acoustic resistance material consisting of non-woven fabric, nylon mesh, or the like is affixed separately. For example, to make fine adjustment of an acoustic resistance value, the acoustic resistance material may further be affixed or provided additionally.

Also, since the metal sheet 10S itself has a function of shielding extraneous electromagnetic waves, a wire mesh 22 (see FIG. 6) for shielding extraneous electromagnetic waves, which has been needed in the conventional example, can be made unnecessary.

Therefore, since the inside diameter of the acoustic tube 10 is enlarged to a diameter close to the inside diameter of the microphone casing 20, as the condenser microphone unit 30, a large-diameter unit of high sensitivity and low noise can be used. Also, since the acoustic resistance material and the wire mesh for shielding extraneous electromagnetic waves are not needed, the cost can be reduced accordingly.

Figure 4A:
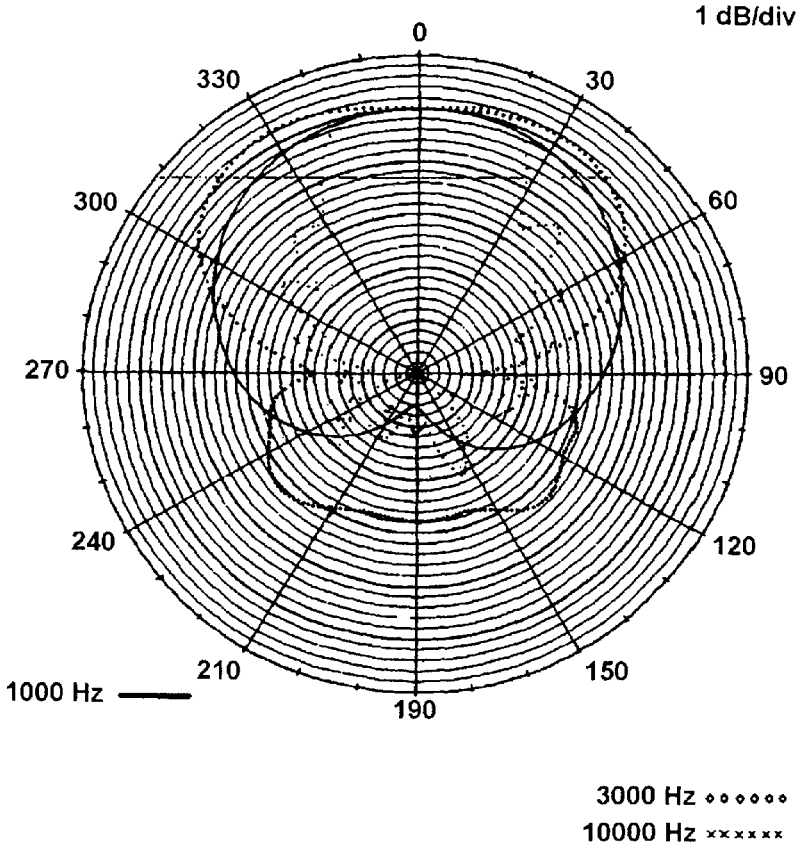
FIG. 4A is a polar pattern diagram showing the directivity of a narrow directional microphone in accordance with an embodiment of the present invention.
Figure 4B:
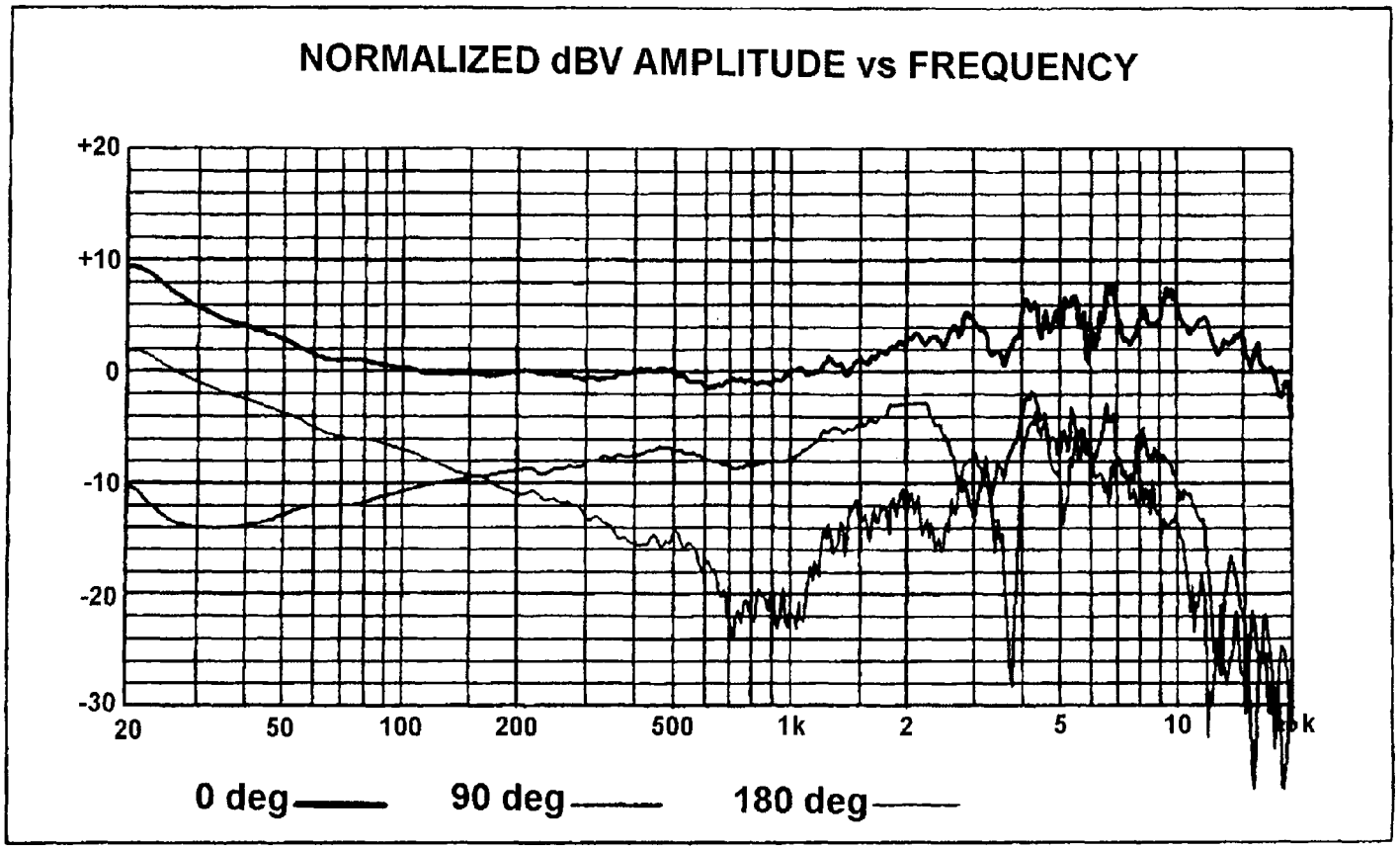
FIG. 4B is a graph showing directional frequency response of a narrow directional microphone in accordance with an embodiment of the present invention.

FIG. 4A shows a polar pattern of the narrow directional microphone of this embodiment provided with the acoustic tube 10 consisting of the metal sheet 10S in which 0.1-mm diameter fine pores are formed at a pitch of 0.25 mm in a zigzag form in the side sound wave introduction ports 13 and the rear sound wave introduction ports 14. FIG. 4B is a graph showing directional frequency response of the narrow directional microphone of this embodiment.

In the polar pattern shown in FIG. 4A, the solid line indicates a pattern of 1000 Hz, the ◇ line indicates a pattern of 3000 Hz, and the x line indicates a pattern of 10,000 Hz. At 1000 Hz, the pattern is a unidirectional cardioid. In contrast, at 3000 Hz or higher, the pattern is a narrow directional hypercardioid.

In the above-described embodiment, pores having equal diameters and equal pitches are formed in both the side sound wave introduction ports 13 and the rear sound wave introduction ports 14 to provide equal acoustic resistance. However, the pore diameter and/or the pitch may be changed as appropriate in the side sound wave introduction ports 13 and the rear sound wave introduction ports 14. In some cases, the rear sound wave introduction ports 14 may be mere openings.

Also, in the above-described embodiment, the metal sheet 10S is used as a sheet for the acoustic tube 10. However, a synthetic resin sheet (preferably, a synthetic resin sheet having metalized film) may be used if it can be rounded and has an elastic restoring force.

The invention claimed is:

1. A narrow directional microphone comprising:

an acoustic tube having a front end opened as a front sound wave introduction port, a side sound wave introduction port in a tube peripheral surface thereof, and a rear sound wave introduction port on a rear end side;

a unidirectional condenser microphone unit disposed between the side sound wave introduction port and the rear sound wave introduction port in the acoustic tube; and a cylindrical microphone casing which is larger in diameter and longer than the acoustic tube, having an opening in a portion corresponding to the side sound wave introduction port and the rear sound wave introduction port, and arranged so as to cover the acoustic tube, wherein the acoustic tube includes a cylindrical body formed of a rounded flexible sheet, and having a large number of pores formed in the sheet at at least the side sound wave introduction port; and the sheet is a metal sheet, and the large number of pores having pore diameters and pitches substantially equal.

2. The narrow directional microphone according to claim 1, wherein the large number of pores are formed in the metal sheet by etching.

3. The narrow directional microphone according to claim 1, wherein the sheet is elastically deformable, and is stuck fast to an inner surface of the microphone casing by the restoring force of the sheet.

4. The narrow directional microphone according to claim 1, wherein the large number of pores in the sheet forms acoustic resistance at the side sound wave introduction port to provide a stable acoustic resistance to the acoustic tube.

5. The narrow directional microphone according to claim 4, wherein the acoustic tube is mounted directly to contact an inside surface of the cylindrical microphone casing.

6. The narrow directional microphone according to claim 5, wherein the large number of pores is formed only in the side sound wave introduction port and the rear sound wave introduction port.

7. The narrow directional microphone according to claim 6, wherein the large number of pores in the side sound wave and the large number of pores in the rear sound wave introduction port have different diameters or pitches each other.

8. The narrow directional microphone according to claim 4, wherein the rear sound wave introduction port is an opening.

9. A narrow directional microphone comprising:

an acoustic tube the front end of which is open as a front sound wave introduction port and which has a side sound wave introduction port in the tube peripheral surface thereof and is provided with a rear sound wave introduction port on the rear end side;

a unidirectional condenser microphone unit disposed between the side sound wave introduction port and the rear sound wave introduction port in the acoustic tube; and a cylindrical microphone casing which is larger in diameter and longer than the acoustic tube, has an opening in a portion corresponding to the side sound wave introduction port and the rear sound wave introduction port, and is arranged so as to cover the acoustic tube, wherein the acoustic tube consists of a cylindrical body formed by rounding a flexible sheet, and at least the side sound wave introduction port is formed by a large number of pores formed in the sheet, and the sheet consists of a synthetic resin sheet having metalized film.

* * * * *